US006179513B1

(12) United States Patent
Marasco

(10) Patent No.: US 6,179,513 B1
(45) Date of Patent: Jan. 30, 2001

(54) CANOPY CLAMP TENSIONING RAFTER

(75) Inventor: Albert P. Marasco, Clive, IA (US)

(73) Assignee: Carefree/Scott Fetzer Company, Broomfield, CO (US)

( * ) Notice: Under 35 U.S.C. 154(b), the term of this patent shall be extended for 0 days.

(21) Appl. No.: 09/201,073

(22) Filed: Nov. 30, 1998

(51) Int. Cl.[7] ..... E04F 16/00

(52) U.S. Cl. ..... 403/374.5; 403/109.3; 403/109.5; 403/322.4; 160/71; 160/80; 135/88.12; 135/88.17

(58) Field of Search ..... 160/67, 71, 80, 160/66; 135/88.12, 88.1, 88.11, 88.17; 403/109.3, 109.5, 322.4, 374.5, 110, 374.2, 374.1, 109.1, 109.2, DIG. 8

(56) References Cited

U.S. PATENT DOCUMENTS

| | | | | |
|---|---|---|---|---|
| 1,011,495 | | 12/1911 | Rupert | 160/268.1 |
| 1,216,594 | | 2/1917 | Murray | 160/268.1 |
| 2,473,305 | | 6/1949 | Schmaus | 160/268.1 |
| 4,169,297 | * | 10/1979 | Weilhrauch | 403/347.2 |
| 4,640,332 | * | 2/1987 | Turner | 160/71 X |
| 5,314,153 | | 5/1994 | White . | |
| 5,369,850 | | 12/1994 | Noble . | |
| 5,592,982 | | 1/1997 | Murray et al. . | |
| 5,848,629 | * | 12/1998 | Baka | 160/67 |
| 5,909,761 | * | 6/1999 | Murray | 160/71 |

* cited by examiner

*Primary Examiner*—Lynne H. Browne
*Assistant Examiner*—David E. Bochna
(74) *Attorney, Agent, or Firm*—Dorsey & Whitney LLP

(57) ABSTRACT

A clamp for securing a canopy to a telescoping rafter while simultaneously securing the rafter is provided by the present invention. A handle is pivotally mounted on a rafter arm used to support and extend a retractable awning canopy. When the handle is rotated to a first position, the clamp is disengaged and a rafter arm may be extended freely. When the handle is rotated to a second position a spring lock is engaged by a cam attached to the handle, such that the spring lock secures the position of a first member relative to a second member of the telescoping rafter. At least one end of the handle includes a pair of clamping jaws for securing a canopy to the handle. The clamping jaws are tightened or loosened by a thumb screw connecting the jaws. The thumb screw may also be used to secure the handle to the rafter when the handle is not in use.

7 Claims, 7 Drawing Sheets

CANOPY CLAMP TENSIONING RAFTER

FIELD OF THE INVENTION

The present invention generally relates to retractable awnings and more particularly to a clamp adapted to minimize flapping of an awning canopy during inclement whether while also securing the position of a rafter.

BACKGROUND OF THE INVENTION

Retractable awnings have been utilized for many years to provide shade or other protection to doorways, windows, or to overlie an area adjacent to a building structure such as a patio or deck. More recently, retractable awnings have been mounted on movable structures such as travel trailers, mobile homes, recreational vehicles, and the like.

In any of the above uses, however, a prevalent problem has been damage to the canopy of the awning caused when inclement weather conditions, such as high winds, cause the canopy to flap thereby tearing or in some cases stretching the canopy fabric.

Most, if not all, retractable awnings include rafter arms which extend from a support surface for the awning to the outer edge of the awning canopy when the awning is extended. A fastening mechanism is often provided on the rafter arm to position the rafter at a desired length and the awning assembly a fixed distance from the ground. Commonly, fasteners such as screws, or bolts with cotter pins, are inserted through an opening on an external rafter member which is aligned with an opening on an interior rafter member. The fastener then holds the rafter members in a relative position until removed.

Additionally, to prevent damage to awning canopies, systems have been developed which utilize clamps to connect the edges of a canopy to the rafter arms. These clamps are typically characterized by being removable and by a pair of jaws that encompass both the adjacent rafter arm and the awning canopy so as to simultaneously grip the rafter arm and the canopy. When removed, however, both the clamps and the fasteners used to secure the rafter arms often must be stored at a remote location and, therefore, are frequently lost or at a minimum become a nuisance.

Most recently, clamps have been designed which when not in use are stowed on the rafter arms. These clamps are often permanently mounted at a first end to the rafter arm and screwably mounted at a second end to an opening in the rafter. When it is desirable to secure the awning to the rafter, the second end of the clamp is unscrewed and the clamp is then rotated ninety degrees. While this approach has eliminated the need to store the clamps when the awning is not in use, it has not eliminated the need to store the fasteners used in aligning the interior and exterior rafter members. Additionally, inserting the fasteners to align the rafter members often requires use of an extension ladder, tools, and the like to properly align the openings in the rafter members and insert and sufficiently secure the fastener. For persons with a disability or physical limitations, such alignment, insertion, and securing of fasteners can often prove problematic.

Thus, a device which allows for the raising, aligning and securing of rafter members while also providing a clamp for securing an awning to the rafter member is needed. Additionally, a clamp which can be operated without the use of any additional tools or specialized skills is needed.

SUMMARY OF THE INVENTION

The canopy clamp tensioning rafter of the present invention has been designed to be incorporated on the rafter arm conventionally found on a retractable awning in a manner such that it is movable between a use position and a non-use position. In the use position, the clamp is adapted to secure the interior rafter member in a position relative to the exterior rafter member without the use of any additional tools, parts, or members. Additionally, the present invention is adapted to grip the side edge of a canopy for a retractable awning, secure the canopy to the rafter arm at that location, and thereby prevent the flapping of the canopy in inclement weather conditions. In the non-use position, the clamp is preferably secured in a position along the exterior rafter. Additionally, the clamp has a very low profile so that the rafter arm can be positioned adjacent the support surface of the awning when the awning is retracted in a conventional manner.

It is another object of the present invention to provide a clamp which allows for an infinitely adjustable rafter. The clamp of the present invention may lock an interior rafter member at any point along the length of an exterior rafter member by the mere rotation of the clamp. Under the present invention, alignment holes, tabs, inserts, or the like are not utilized to retain an interior rafter member in a predetermined position relative to an exterior rafter member.

It is another object of the present invention to provide a clamp which may be rotated in any direction (clockwise or counter-clockwise) and thereby suitably secure an interior member relative to an exterior member.

Another object of the present invention is to provide a lever activated clamp which secures rafter members relative to each other while also securing a canopy to the rafter.

The present invention fulfills each and all of the these objectives by providing a clamp that is pivotally connected to an associated rafter arm so as to be movable in either direction between use and non-use positions. The clamp includes a lever arm comprised of a base member and a top member which together form a set of clamping jaws at the distal end. The clamping jaws are selectively and alternately movable between open and closed conditions. In the closed condition, the canopy is gripped between the jaws thereby immobilizing the canopy relative to the rafter arm to which the clamp is secured. The clamp also includes a cam and spring lock mechanism. The cam is disposed at least partially within the clamp such that the cam engages the spring lock mechanism upon rotation of the lever arm. When engaged, the spring lock mechanism is designed to grip the inner edges of the inner rafter member and thereby secure the position of the inner rafter member relative to the outer rafter member. A fork cam lock suitably disposed within the innards of the rafter and secured to the outer rafter member secures the position of the spring lock relative to the outer rafter member.

Other aspects, features, and details of the present invention can be more completely understood by reference to the following detailed description of a preferred embodiment in conjunction with the drawings and from the appended claims.

BRIEF DESCRIPTION OF THE DRAWING FIGURES

DETAILED DESCRIPTION OF A PREFERRED EMBODIMENT

Figure 1:
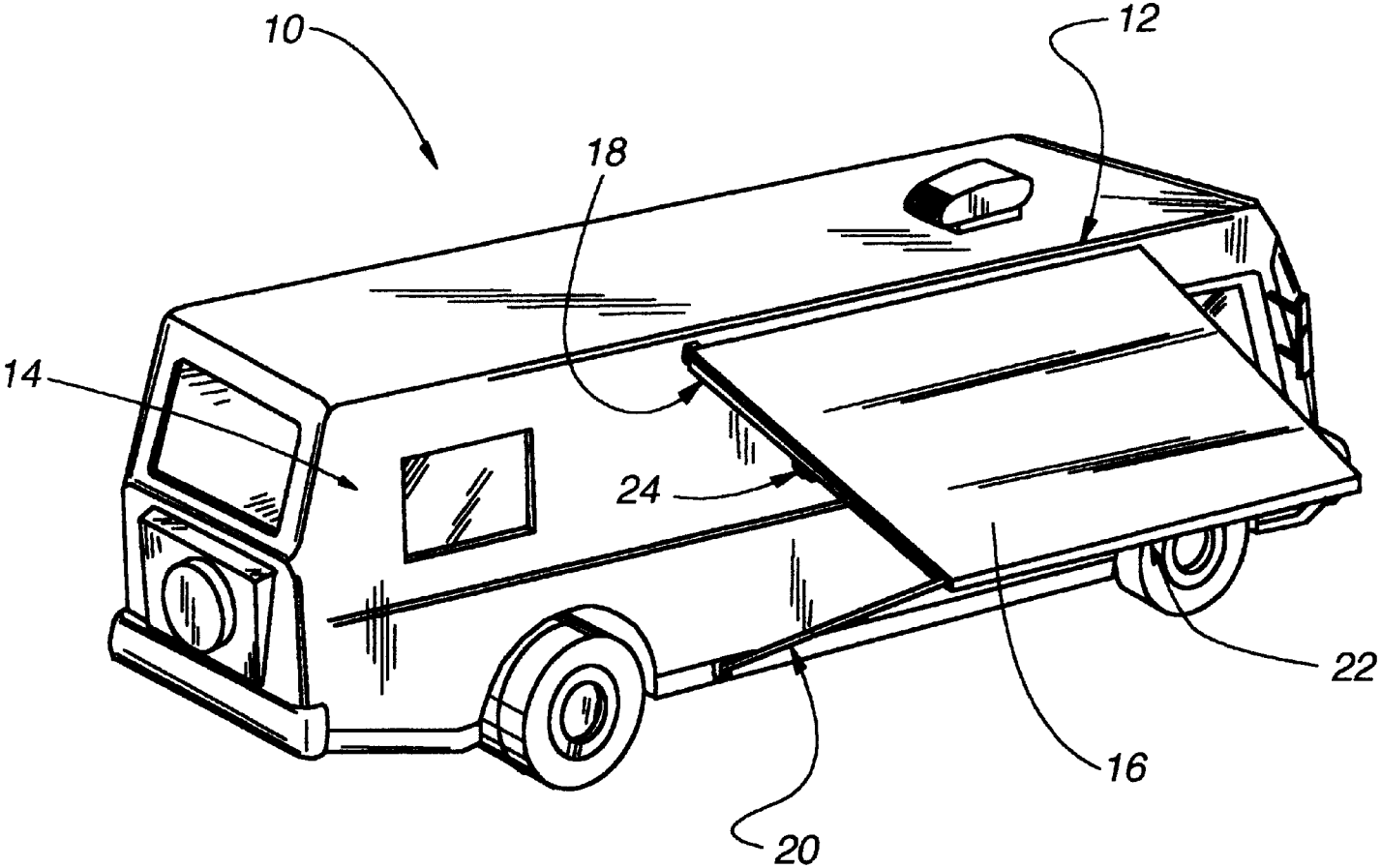
FIG. 1 is an isometric view of a recreational vehicle having a retractable awning thereon in an extended position with a pair of clamps of the present invention being operative in a use position to stabilize the canopy and secure the position of an inner rafter member relative to an outer rafter member.
Figures 2, 3:
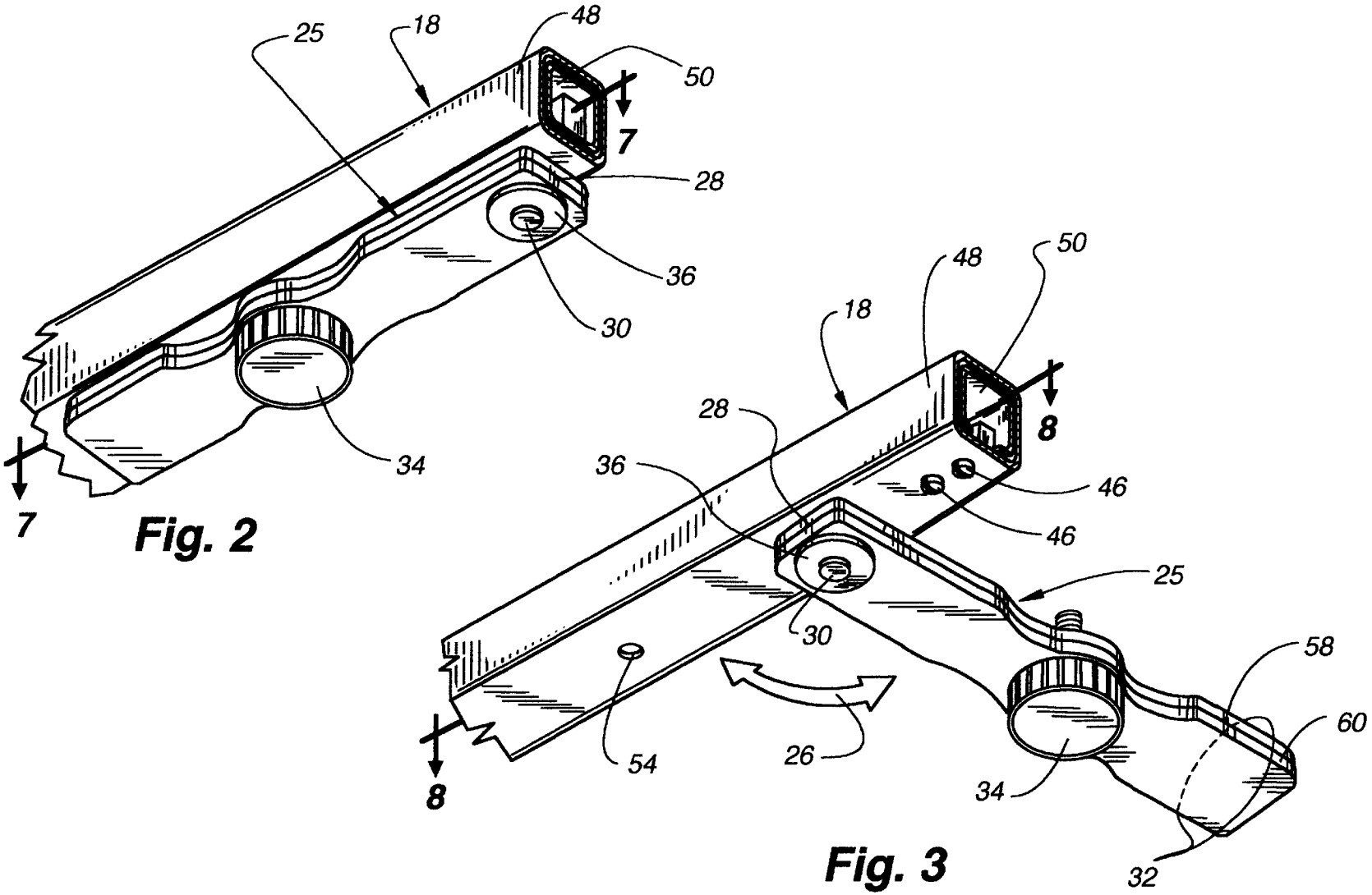
FIG. 2 shows a clamp in a preferred embodiment of the present invention in the nonuse position.
FIG. 3 shows a clamp in a preferred embodiment of the present invention in the use position.

With reference now to FIG. 1, a recreational vehicle 10 having a retractable awning 12 mounted on the side 14 thereof in an extended position is shown. The awning 12 is movable between the extended position shown in FIG. 1 and a retracted position which is not shown. The awning includes a canopy 16, a pair of rafter arms 18 extending on either side of the canopy 16, a pair of support arms 20 associated with the rafter arms 18, and a roll bar (not shown) at the top of the awning 12 about which the canopy 16 is wrapped when moved to the retracted position (not shown). The outer edge 22 of the canopy 16 may be secured to a lead bar or roll bar in any conventional manner. The inner end of the rafter arms 18 and the support arms 20 are also secured to the support surface. A clamp 24 of the present invention is suitably disposed on each rafter arm 18. While the preferred embodiment of the present invention is herein described in the context of an awning secured to a side 14 of a recreational vehicle 10, it is to be understood that the present invention is not to be so limited. The present invention may be suitably adapted for attachment to any surface including, but not limited to, houses, camper shells, free standing apparatus, or the like. Additionally, the clamp of the present invention is not limited to only securing awnings, canopies, or the like. The clamp of the present invention may be suitably adapted for securing any telescoping interior member relative to an exterior member by way of a simple lever without departing from the spirit or scope of the present invention. Referring now to FIG. 2, a preferred embodiment of a clamp 24 of the present invention is shown in a non-use position. In the non-use position, the handle 25 of the clamp 24 is preferably aligned parallel to the length or span of the rafter arms 18, thereby facilitating ease of storage and securing of the handle 25 to the rafter arms 18 when the clamp 24 is not in use. However, the clamp 24 may be suitably modified such that it is in a non-use position when extended perpendicular to the rafter arms 18 without departing from the spirit or scope of the present invention.

FIG. 3 shows the clamp 24 in a use position. As shown by the arrow 26, the handle 25 may be rotated ninety degrees, from the non-use position shown in FIG. 2, into a use position. Preferably, the handle 25 may be suitably rotated 360 degrees in either a clockwise or counter-clockwise direction to position the clamp 24 in either a use or non-use position. In the preferred embodiment, the use position is engaged whenever the handle 25 is rotated ninety degrees (in any direction) from the non-use position.

As shown in FIG. 2 and 3, the handle 25 preferably pivots around a pivot pin 30 positioned near a first end 28 of the handle 25. A washer 36 separates the pin 30 from the handle 25, thereby reducing the friction between the handle 25 and the rafter 18. However, the clamp 24 can be suitably modified such that the pin 30, washer 36, and the center of rotation, is situated anywhere along the length of the handle 25. For example, the clamp 24 could be suitably configured such that it rotates about the center of the handle 25 and thereby provide two ends upon which clamping jaws could be situated. The pin 30 can be any suitable fastening device which allows a member to pivot about its axis and secures the handle 25 to a cam 40 (see FIG. 5). Such fasteners include, but are not limited to, bolts, screws, rivets, cotter pins, or the like. In a preferred embodiment, the pin 30 is a semi-tubular pull rivet.

Figure 5:
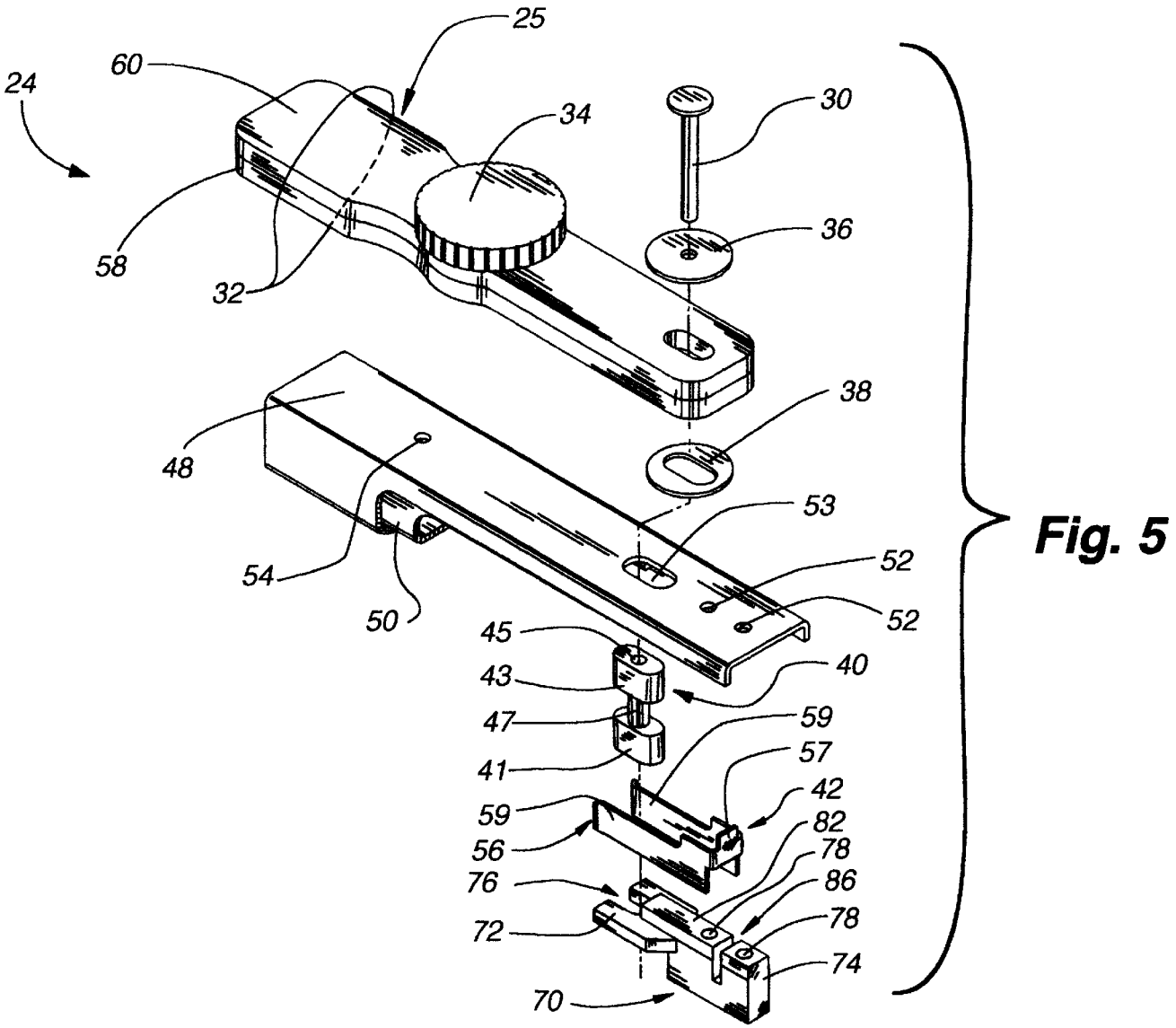
FIG. 5 is an exploded view from the top of the clamp in a preferred embodiment of the present invention.

The handle 25 preferably includes a base member 58 and a top member 60 which thereby form a clamping jaw structure. The base member 58 and the top member 60, as shown in FIG. 5, are preferably shaped such that a larger surface area is provided at the far end 32 of the handle 25 relative to the surface area at the first end 28 of the handle 25. Thereby, facilitating the gripping feature of the handle 25 while minimizing the weight and friction generated between the handle 25 and the rafter 18 near the point of rotation of the handle 25. The base member 58 and the top member 60 preferably include curved sections near the middle of the length or span of the handle 25 to facilitate ease of grasping and use. The handle 25 is preferably plastic, however, any suitable material may be used. The far end 32 of the handle 25 is suitably disposed with ruffled edges, friction pads, or the like, on the inner sides (not shown) of the base member 58 and the top member 60 such that a canopy 16 may be retained by the clamp 24.

Figure 6:
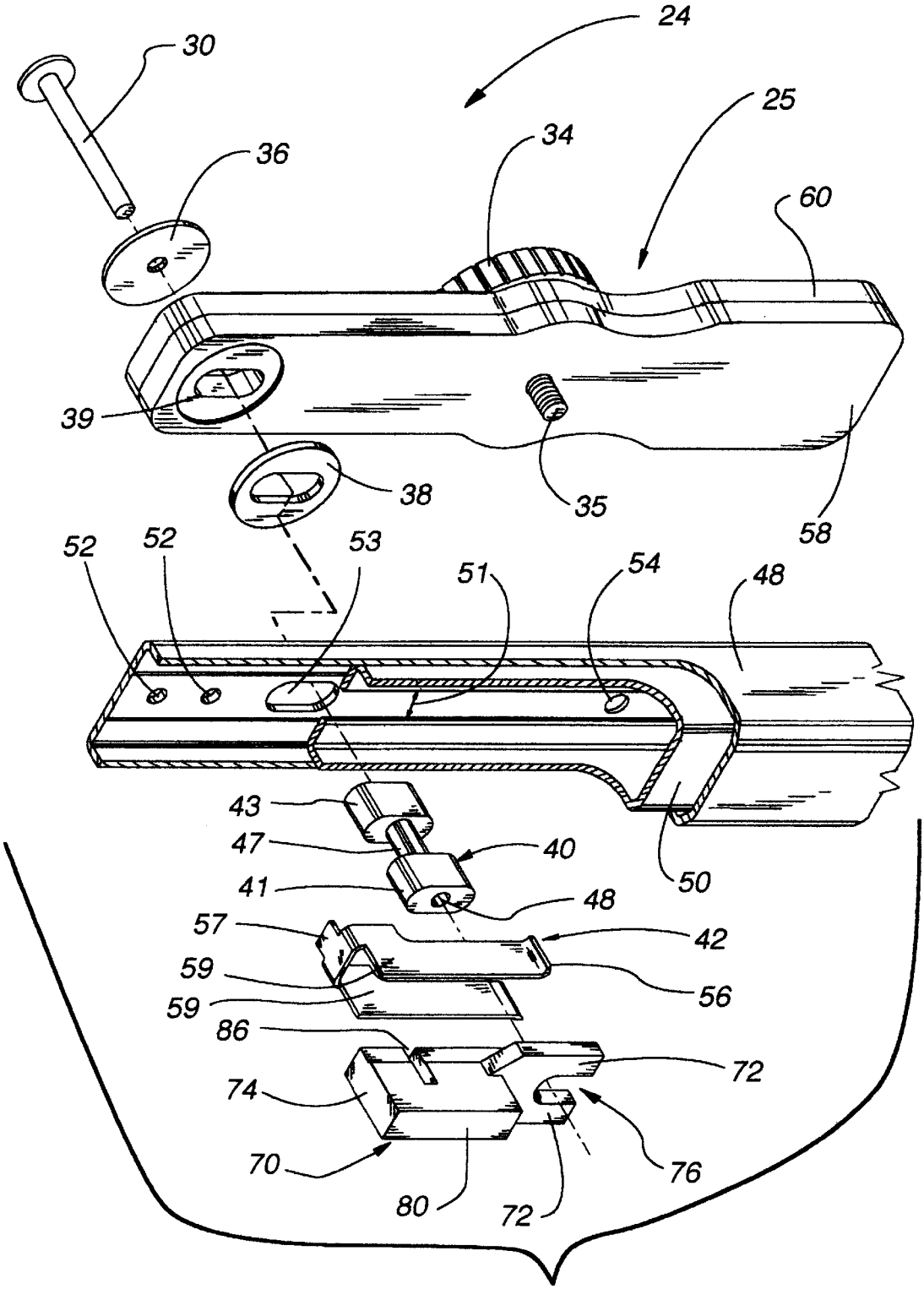
FIG. 6 is an exploded view from through the rafter of the clamp in a preferred embodiment of the present invention.

The base member 58 and top member 60 have a threaded opening through which a thumb screw 34 is inserted. The thumb screw 34 is suitably disposed on the handle 25 such that the thumb screw 34 may be threaded through the top member 60 and the base member 58 so as to tighten the base member 58 and the top member 60 relative to each other and thereby securely fasten the handle 25 to a canopy 16 inserted between the two members 58 and 60. Preferably, the thumb screw 34 is of such dimensions as to allow a person to loosen or sufficiently tighten the thumb screw 34 to hold a canopy 16 without using any tools. However, the present invention is not to be so limited. Any fastener may be utilized in the present invention. As shown in FIG. 6, the thumb screw 34 preferably has a shaft 35 of sufficient length to secure the handle 25 to an outer rafter member 48 when the clamp 24 is not in use.

Figure 4:
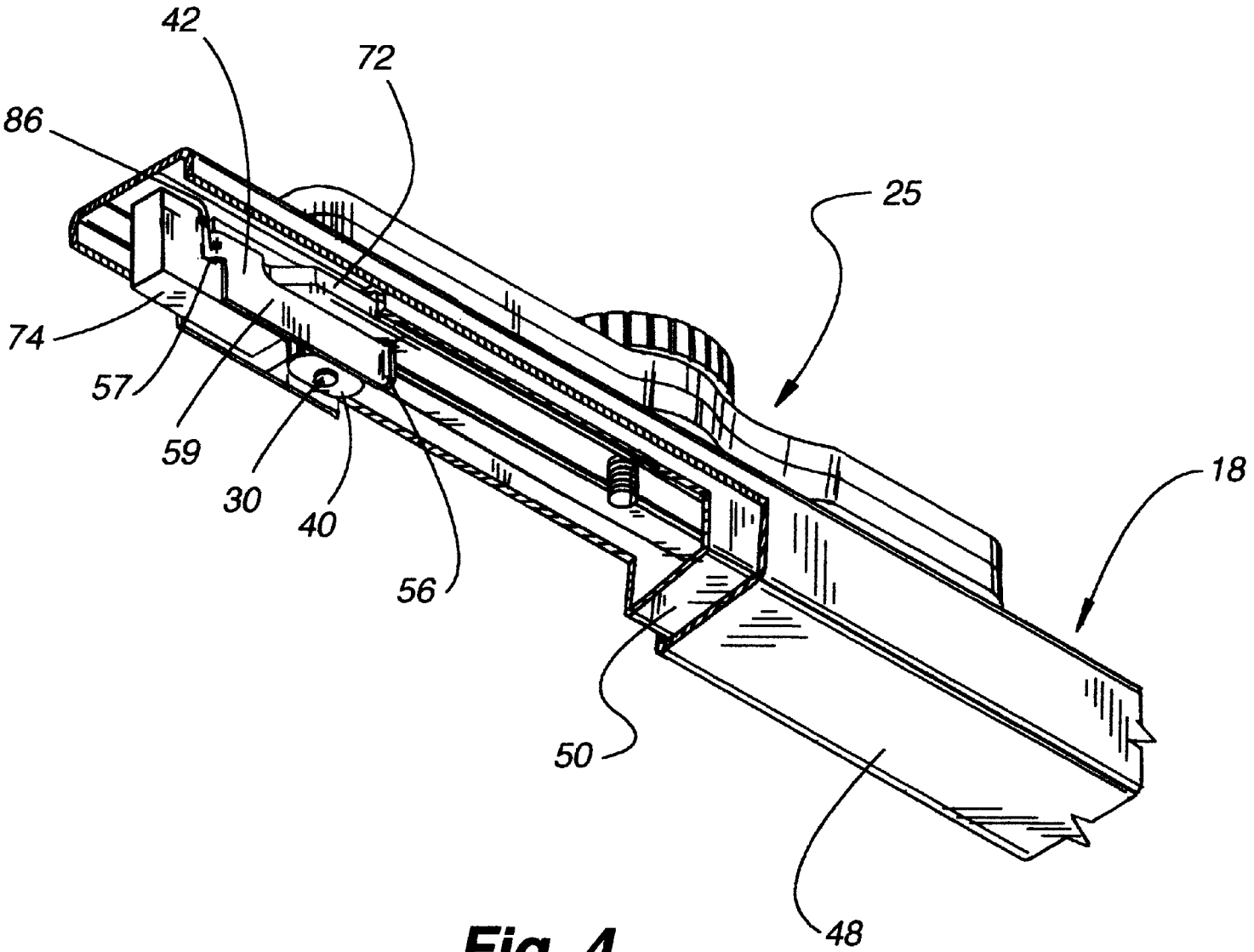
FIG. 4 is a cut-away view of a clamp in a preferred embodiment of the present invention mounted on a rafter and in a non-use position.

As shown in FIG. 4, the handle 25 of the clamp 24 is preferably attached via pin 30 to a cam 40 positioned within the inner portion of the rafter 18. The rafter 18 preferably includes an outer rafter member 48 and an inner rafter member 50. The inner member 50 being suitably disposed to slide telescopically within the outer member 48 and thereby extend or contract the effective length of the rafter 18 as needed. Preferably, the outer member 48 is configured as a hollow tube with flat sides. The inner member 50 is preferably configured in a substantially closed U shape such that the movement of the inner member 50 relative to the outer member 48 is not inhibited by the clamp 24 or associated hardware. The inner member 50 is also preferably configured with flat sides to facilitate better gripping by the spring lock 42. However, the outer member 48 and inner member 50 can be of any size, shape, or configuration which accommodates the clamp 24 of the present invention.

The rafter members 48 and 50 may be manufactured from any suitable material, however, aluminum is preferred. The rafter members 48 and 50 are also of sufficient thickness and dimensions to stabilize and support the awning 12 in all weather conditions. The outer rafter member 48 preferably contains a set of openings 52 through which fasteners may be inserted. An opening 53 is also provided for inserting the various parts comprising the clamp 24 into the cavities provided within the rafter members 48 and 50. Additionally, a threaded opening 54 is provided in the outer rafter member 48 through which the shaft 35 may be inserted to fasten the clamp 24 to the rafter 18.

Referring now to FIGS. 5 and 6, the handle 25 is preferably separated from the rafter 18 by a spacer 38. The base member 58 preferably includes a recession 39 within which the spacer 38 is predominately situated, thereby minimizing the height of the base member 58 above the rafter 18 when assembled while also providing a low friction interface between the handle 25 and the rafter 18. The spacer 38 is preferably configured with an oval opening.

The clamp 24 further includes a cam 40. The cam 40 is preferably configured in a barbell shape. The bar 47 is of sufficient length to provide a separation between the first bell 41 and the second bell 43 such that the first bell 41 may be inserted into the rafter 18 and below a retaining bracket or the like while the second bell 43 remains outside the rafter 18 and may be inserted into the handle 25. The bells 41 and 43 are preferably oval in shape. An opening 45 is provided throughout the length of the cam 40 for inserting a suitable fastener into the cam 40. The cam 41 is preferably stainless steel, however, any material which is provides the desired tensile strength and durability may be utilized.

A fork cam lock 70 is also included in the clamp 24. The fork cam lock 70 preferably provides a solid member within the rafter 18 for retaining the cam 40 and the spring lock 42. Referring still to FIGS. 5 and 6, the fork cam lock 70 provides a forked section 72 having two tongs separated by a half oval opening 76. The dimensions of the half oval opening 76 being such as to allow the bar 47 portion of the cam 40 to rotate therein about an axis running perpendicular to the forked section 72. The forked section 72 being situated a sufficient distance above the base 80 of the fork cam lock 70. The base 80 being approximately parallel with the bottom of the first bell 41 when the clamp 24 is completely installed. The forked section 72 additionally being situated slightly below the top 82 of the fork cam lock 70 such that when installed sufficient separation exists between the top 82 and the top of the forked section 72 to allow the inner rafter member 50 to slide above the forked section 72 while the top 82 is mounted flush with the inner top surface of the outer rafter member 48, while also accommodating a narrower slot 51 in the top of the inner rafter member 50.

The fork cam lock 70 also includes a slot 86 in the base member 74 for retaining the spring lock 42. The slot 86 is preferably slightly wider than the thickness of the spring lock 42. Additionally, the slot 86 is of sufficient depth to allow the bottom of the spring lock 42, when inserted therein, to be substantially parallel with the bottom 80 of the fork cam lock 70. The fork cam lock 70 also preferably includes a set of opening 78 (see FIG. 5) into which a suitable fastener may be inserted for securing the fork cam lock 70 to the outer rafter member 48. The fork cam lock 70 is preferably made from zinc, however, any material may be used.

The spring lock 42 preferably is configured into a modified "U" such that when installed the spring sides 59 rest below the forked section 72, and the base 57 rests in the slot 86 of the fork cam lock 70. The base 57 includes a tab portion which extends above the upper most level of the spring sides 59 so as to force the spring lock 42 into the slot 86 when the combined fork cam lock 74 and spring lock 42 are fastened to the outer rafter member 48. Additionally, the ends 56 of the spring lock 42 are preferably burred and extend slightly outwards so as to better grip the interior surface of the outer member 48 when the clamp 24 is in the use position.

The spring lock 42 is preferably designed such that 100–200 pounds of force are required for activation/deactivation of the clamp. However, the spring lock 42 may be set to any force range. Factors influencing the force range include the weight of the awning to be supported, intended uses of the rafter and clamp, and the maximum strength desired to operate the clamp. The spring cam lock 42 may be made from any material. In a preferred embodiment, the spring lock 42 is stainless steel.

The configuration and inter-operation of the various components included in the clamp 24 will now be discussed. As shown in FIGS. 5 and 6, the second bell 43 is secured through the spacer 38 and into the handle 25 by the pin 30, wherein the pin 30 is separated from direct contact with the handle 25 by the washer 36. When assembled, the first bell 41 extends through opening 53 provided in the outer rafter member 48 such that the first bell 41 extends into the inner cavity of the rafter 18. The spring lock 42 is positioned over the fork cam lock 70 such that the spring sides 59 extend below the forked portion 72 and on either side of the base member 74, as shown in FIG. 4. When the spring lock is positioned on the fork cam lock 70, the forked portion 72 can be slid above the first bell 41 extending through the opening 53. The fork cam lock 70 is secured to the outer rafter member 48 by a fastener 46, as shown in FIG. 3. The fastener 46 may be rivets, screws, or the like. In this manner, the cam 40 is restrained within the rafter 18 by the fork cam lock 70 and no actual fastening of the cam 40 or the pin 30 to the rafter 18 is necessary to secure the handle 25 to the rafter 18.

Figure 8:
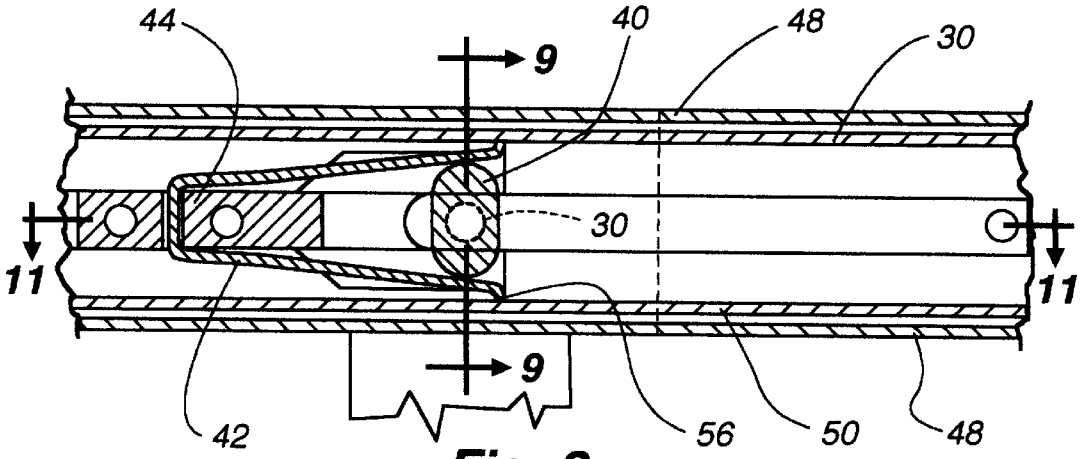
FIG. 8 is a section of a preferred embodiment of the clamp of the present invention situated in a use position on a rafter taken along the line 8—8 of FIG. 3.
Figure 9:
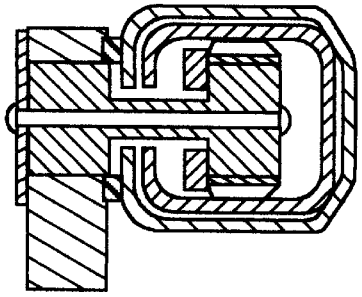
FIG. 9 is a section of a preferred embodiment of the clamp of the present invention situated in a use position on a rafter taken along the line 9—9 of FIG. 8.
Figure 7:
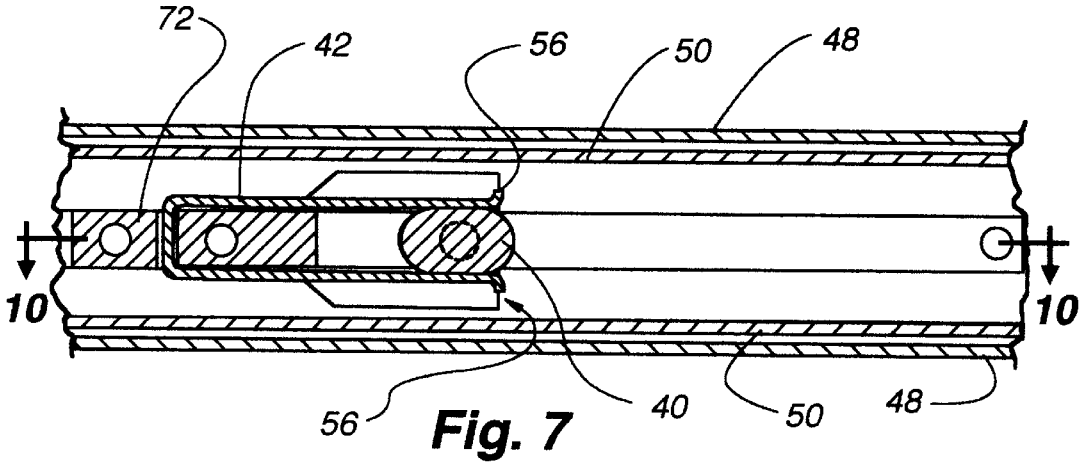
FIG. 7 is a section of a preferred embodiment of the clamp of the present invention situated in a non-use position on a rafter taken along the line 7—7 of FIG. 2.
Figure 11:
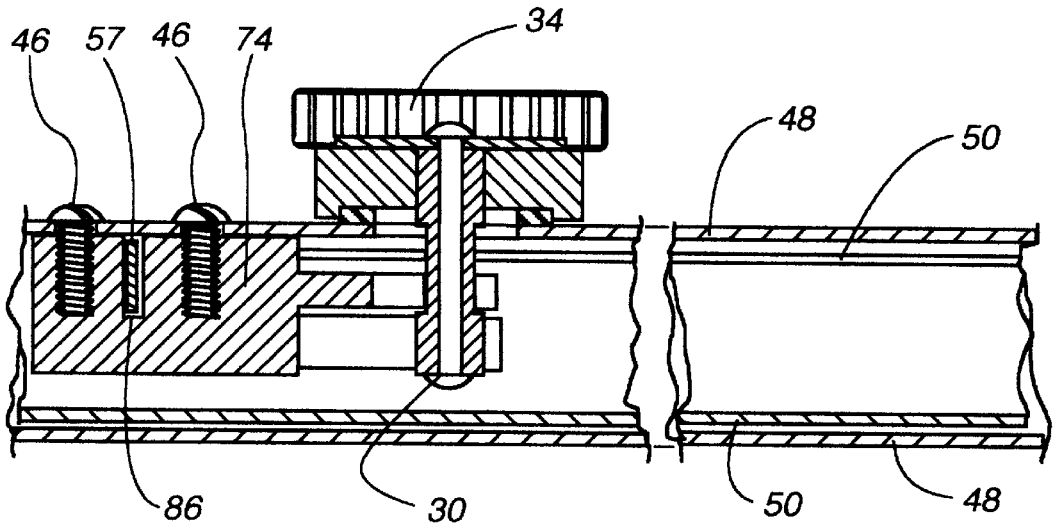
FIG. 11 is a section of a preferred embodiment of the clamp of the present invention situated in a use position on a rafter taken along the line 11—11 of FIG. 8.
Figure 10:
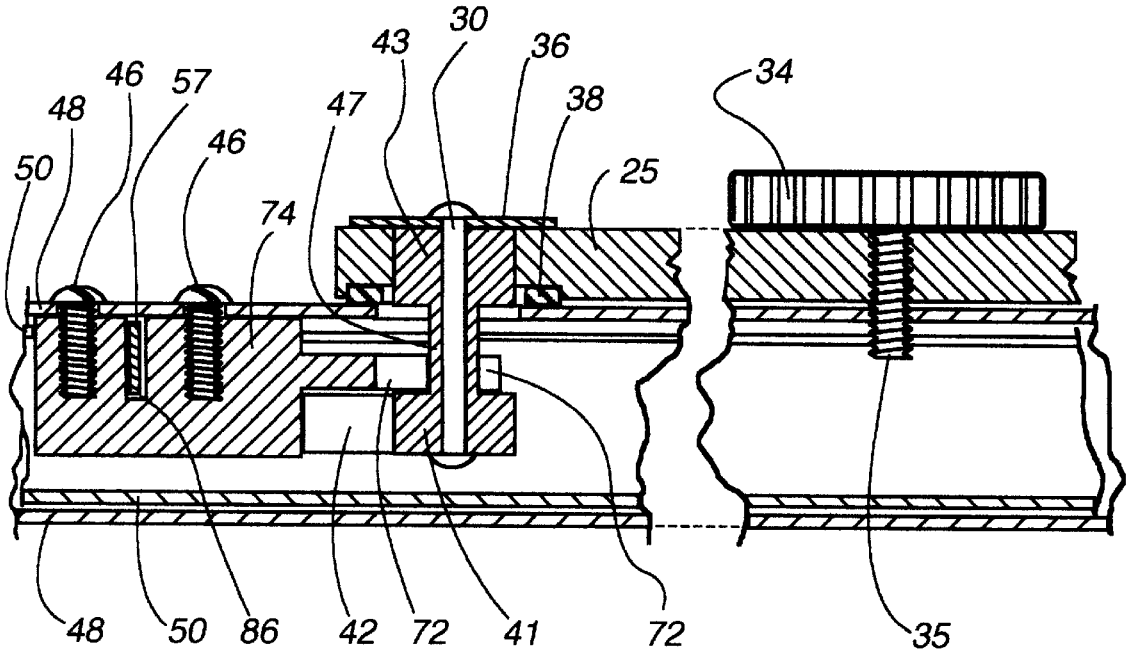
FIG. 10 is a section of a preferred embodiment of the clamp of the present invention situated in a non-use position on a rafter taken along the line 10—10 of FIG. 7.

The inter-operation of the various clamp 24 components is such that when the cam 40 is rotated ninety degrees (from the non-use position as shown in FIG. 5), the first bell 41 forces the ends 56 of the spring lock 42 against the sides of the inner member 50, as shown in FIGS. 8, 9, and 11. Similarly, when the cam 40 is rotated to the non-use position shown in FIGS. 7 and 10, the first bell 41 does not apply force to the ends 56 of the spring lock 42 and the spring lock 42 does not engage the sides of the inner member 50.

A feature of the clamp of the present invention is that it allows an operator to activate the clamp without requiring the hand dexterity normally associated with a screwing motion. The mere rotation of the lever is sufficient to engage the clamp of the present invention. The length of the base member 58 and top member 60 may be extended or shortened as necessary to either reduce or increase the rotational force necessary to engage/disengage the clamp 24.

It will be appreciated, that the handle 25 may be secured to the rafter 18 by an appropriate fastener. In the preferred embodiment, the handle 25 is secured to the rafter in the non-use position by the screwing of thumb screw 34 into a suitable opening 54 on the outer member 48. Additionally, any clamping mechanism may be utilized in the present invention to secure a canopy 16 to the clamp 24. The present invention is not to be construed as being limited to the thumb screw 34 shown.

The clamp 24 of the present invention thereby provides an apparatus for securing a canopy 16 to a rafter 18 while also securing the position of an inner rafter member 50 relative to an outer rafter member 48. The present invention eliminates the need for tools to secure the canopy 16 and/or rafter 18, while also providing a simple to use lever mechanism. The present invention, utilizing the friction present between the spring lock 42 along the inside of the inner rafter member 50, also allows for the rafter 18 to be adjusted to any length. Additionally, by utilizing a first bell 41 to force the spring sides 59 into the sides of the inner rafter member 50, the present invention allows the clamp to be rotated in any direction to either engage or disengage the spring clamp 42. By providing a thumb screw 34 with a shaft 35 of sufficient length to facilitate fastening of the handle 25 to the outer rafter member 48, the clamp 24 of the present invention eliminates the need for storing canopy clamps, rafter adjusters, or the like.

Although the present invention has been described with a certain degree of particularity, it is understood that the present disclosure has been made by way of example, and changes in detail or structure may be made without departing from the spirit of the invention as defined in the appended claims.

What is claimed is:

1. The combination of a clamps a first rafter member and a second rafter member slidably disposed within said first rafter member of a retractable awning, comprising:

a handle;

a fork cam lock secured to said first rafter member;

a cam in communication with said handle and secured in place by said fork cam lock; and a spring lock in operative association with said cam and secured to said fork cam lock such that a rotation of said handle from a first position to a second position results in the application of force by said cam upon said spring lock such that said spring lock is in contact with said second rafter member and prevents the movement of said second rafter member relative to said first rafter member, and a rotation of said handle from said second position to said first position results in the removal of force by said cam upon said spring lock such that said spring lock is no longer in contact with said second rafter member allowing said second rafter to move freely relative to said first rafter member.

2. The combination of claim 1 wherein said handle when in said first position extends in substantially parallel relationship to said first rafter member and when in said second position extends in substantially perpendicular relationship to said first rafter member.

3. The combination of claim 1 wherein said handle when in said first position extends in substantially perpendicular relationship to said first rafter member and when in said second position extends in substantially parallel relationship to said first rafter member.

4. The combination of claim 1 wherein said clamp further includes a pivot pin adjacent to one end of said handle, said handle being pivotal about said pin, and said cam being secured to said pivot pin.

5. The combination of a clamp, a first rafter member and a second rafter member slidably dispose within said first rafter member of a retractable awning, comprising:

a handle;

a fork cam lock secured to first rafter member;

a cam in communication with said handle and secured in place by said fork cam lock;

a spring lock in operative association with said cam and secured to said fork cam lock such that a rotation of said handle from a first position to a second position results in the application of force by said cam upon said spring lock such that said spring lock is in contact with said second rafter member and prevents the movement of said second rafter member relative to said first rafter member, and a rotation of said handle from said second position to said first position results in the removal of said force by said cam upon said spring lock such that said spring lock is no longer in contact with said second rafter member allowing said second rafter member to move freely relative to said first rafter member;

a base member;

a top member disposed above said base member; and a fastener wherein said fastener when tightened fastens said top member to said base member such that an item inserted between said top member and said base member may be secured to said first rafter member, and when such fastener is loosened, a separation between said top member and said base member occurs such that said item is not secured to said first rafter member.

6. The combination of claim 5 wherein said handle further comprises ruffled edges on at least one distal end of each base member and top member.

7. The combination of claim 2 wherein said fastener is a thumb screw adapted to draw said top member and said base member into an abutting relationship, said thumb screw also selectably connecting said handle to said first rafter member.

* * * * *